US007017273B2

(12) United States Patent
Foster et al.

(10) Patent No.: US 7,017,273 B2
(45) Date of Patent: Mar. 28, 2006

(54) CANDLEWICK TRIMMING DEVICE

(76) Inventors: Hensley Foster, N144 W14315 Pioneer Rd., Jackson, WI (US) 53037; Kim Albrecht, 2128 W. Kendall Ave., Glendale, WI (US) 53209

( * ) Notice: Subject to any disclaimer, the term of this patent is extended or adjusted under 35 U.S.C. 154(b) by 0 days.

(21) Appl. No.: 10/781,428

(22) Filed: Feb. 18, 2004

(65) Prior Publication Data

US 2005/0178008 A1 Aug. 18, 2005

(51) Int. Cl.
*B26B 17/00* (2006.01)

(52) U.S. Cl. ..... 30/279.2; 30/287; 30/187

(58) Field of Classification Search ..... 30/27, 30/28, 175, 179, 187, 278, 279.2, 191, 286, 30/287

See application file for complete search history.

(56) References Cited

U.S. PATENT DOCUMENTS

| | | | | |
|---|---|---|---|---|
| 18,713 | A | 11/1857 | Stow et al. | |
| 36,590 | A | 9/1862 | Eagle | |
| 80,577 | A | 8/1868 | Warner | |
| 169,785 | A | 11/1875 | DeZeng | |
| 211,209 | A | 1/1879 | Andrews | |
| 452,289 | A | 5/1891 | Scott | |
| 600,650 | A | 3/1898 | Powell | |
| 806,037 | A * | 11/1905 | Wilcox | 30/28 |
| 920,822 | A | 5/1909 | Buckman | |
| 968,740 | A | 8/1910 | Case | |
| 1,499,673 | A * | 7/1924 | Lobl | 30/28 |
| 1,721,415 | A * | 7/1929 | Schnefel | 30/28 |
| 3,812,868 | A * | 5/1974 | Keating | 132/75.4 |
| 4,176,449 | A | 12/1979 | Lee et al. | |
| 4,574,475 | A | 3/1986 | Lee | |
| 4,776,096 | A | 10/1988 | Chang | |
| 4,982,747 | A * | 1/1991 | Shah | 132/75.5 |
| 5,035,054 | A | 7/1991 | Ellenberger | |
| 5,634,275 | A * | 6/1997 | Pine | 30/145 |
| 6,076,262 | A | 6/2000 | Pappas | |
| 6,209,207 | B1 | 4/2001 | Patterson et al. | |
| 6,243,954 | B1 | 6/2001 | Bowers | |
| 6,321,453 | B1 | 11/2001 | Pappas | |
| 6,370,779 | B1 | 4/2002 | Pappas | |
| D458,100 | S | 6/2002 | Bowers | |
| 6,405,441 | B1 | 6/2002 | Rucker | |
| D464,243 | S | 10/2002 | Mosca | |

FOREIGN PATENT DOCUMENTS

| | | | |
|---|---|---|---|
| FR | 2 603 467 | * | 3/1988 |

* cited by examiner

*Primary Examiner*—Hwei-Siu Payer
(74) *Attorney, Agent, or Firm*—Andrus, Sceales, Starke & Sawall, LLP

(57) ABSTRACT

A device for trimming a candlewick trims the wick at a predetermined height above a candle. The device includes first and second elongated gripping arms that are pivotably coupled to each other at a first end. An opening is formed at the first end between the first and second gripping arms. A pair of cutting blades are arranged between and transverse to the elongated gripping arms. The cutting blades are spaced a distance away from the first end of the first and second gripping arms, the distance being equal to the predetermined height. When the first end of the first and second gripping arms is set on the candle such that the candlewick extends through the opening, pivoting the first and second gripping arms causes the cutting blades to trim the candlewick at the predetermined height.

16 Claims, 4 Drawing Sheets

CANDLEWICK TRIMMING DEVICE

FIELD OF THE INVENTION

The present patent application relates to a device for trimming a candlewick and, more specifically, to a device that trims a candlewick at a predetermined height above the fuel portion of the candle.

BACKGROUND OF THE INVENTION

Candles typically include two elements: candle fuel, which typically comprises some type of wax; and a wick, which typically comprises some sort of absorbent twine. When the candle is lit, the wax near the candlewick melts and the candlewick absorbs the liquid wax. The flame vaporizes the liquid wax and burns the wax vapor.

One skilled in the art will recognize that there are many advantages to keeping a candlewick properly trimmed at a predetermined height above the top or "fuel portion" of a candle. For example, if the candlewick is too long, the combustion process in the candle flame will undesirably produce carbon black instead of carbon dioxide. Carbon black contaminates the atmosphere and adheres to anything it comes into contact with, including a candle jar, or interior walls and furnishings. Another drawback of a long candlewick is that the flame will grow too large and will burn the candle fuel faster than desired. A large flame can therefore undesirably limit the useful life of the candle. Alternatively, if the candlewick is cut too short, a small flame will result which may not properly stay lit.

U.S. Pat. No. 6,370,779 recognizes the advantages of trimming a candle to a predetermined height and teaches a candlewick trimmer that is adapted to gauge the length of the candlewick prior to cutting. A gauge finger extends transversely from the blades of the trimmer. The gauge finger is adapted to rest on the fuel portion or top surface of the wax of a candle and gauge the length of the candlewick. This device however has many drawbacks. For example, the gauge finger is difficult to manipulate. The device is also difficult or impossible to operate when the fuel portion of the candle resides within a housing, hurricane or candle jar, recessed from the point of access.

It is therefore desirable to provide an improved device that trims a candlewick at a predetermined height, that is easy to use, and that eliminates the many drawbacks of the prior art. It is desirable to provide such a device that accurately cuts the candlewick at the predetermined height. It is desirable to provide such a device that is easy to construct and that includes a minimal number of parts, thus minimizing the chance for mechanical breakdown. It is desirable to provide such a device that may be used to accurately trim the candlewick on a candle that resides within a housing, hurricane, candle jar, or the like.

SUMMARY OF THE INVENTION

The present invention provides such a device for trimming a candlewick at a predetermined height above a candle. The device includes first and second elongated gripping arms that are pivotably coupled to each other at a first end. An opening is formed at the first end between the first and second gripping arms. A pair of cutting blades are arranged between and transverse to the elongated gripping arms and are spaced a distance away from the first end of the gripping arms. The distance that the cutting blades are spaced away from the first end is equal to the predetermined height at which the candlewick is cut.

In one embodiment the first and second gripping arms have a U-shaped cross section and face each other. A portion of the first gripping arm is narrower than a portion of the second gripping arm such that the first gripping arm fits within the second gripping arm when pivoted towards each other. The pair of cutting blades, which are disposed between the first and second gripping arms, are formed on the first ends of a pair of blade arms. The blade arms are rigidly attached to each other at one end and a connection member is sandwiched between the blade arms. A pin extends laterally through the first and second gripping arms and the connection member to join the blade arms and the gripping arms. The pin resides in vertical slots formed in the first and second gripping arms and in a hole formed laterally through the connection member.

In a particular embodiment, the blade arms each comprise a pair of vertically extending wing members. The wing members abut the interior of the U-shaped gripping arms and translate motion from the gripping arms to the blade arms.

In another embodiment, a pair of lever bars are rotatably attached to the connection member by an axle. The lever bars abut the interior portion of the U-shaped gripping arm and transfer motion from the gripping arms to the blade arms.

When the first end of the first and second gripping arms is set on the candle such that the candlewick extends through the opening, pivoting the first and second gripping arms causes the cutting blades to trim the candlewick at the predetermined height. The trimmed portion of the candlewick is retained by the device as the device is removed from the fuel portion of the candle.

DETAILED DESCRIPTION OF THE PREFERRED EMBODIMENTS

In the preferred embodiments of the present invention described in detail below, a device for trimming a candlewick at a predetermined height above a candle is provided. It should be understood that the drawings and specification are to be considered an exemplification of the principle of the invention, which is more particularly defined in the appended claims.

Figure 1:
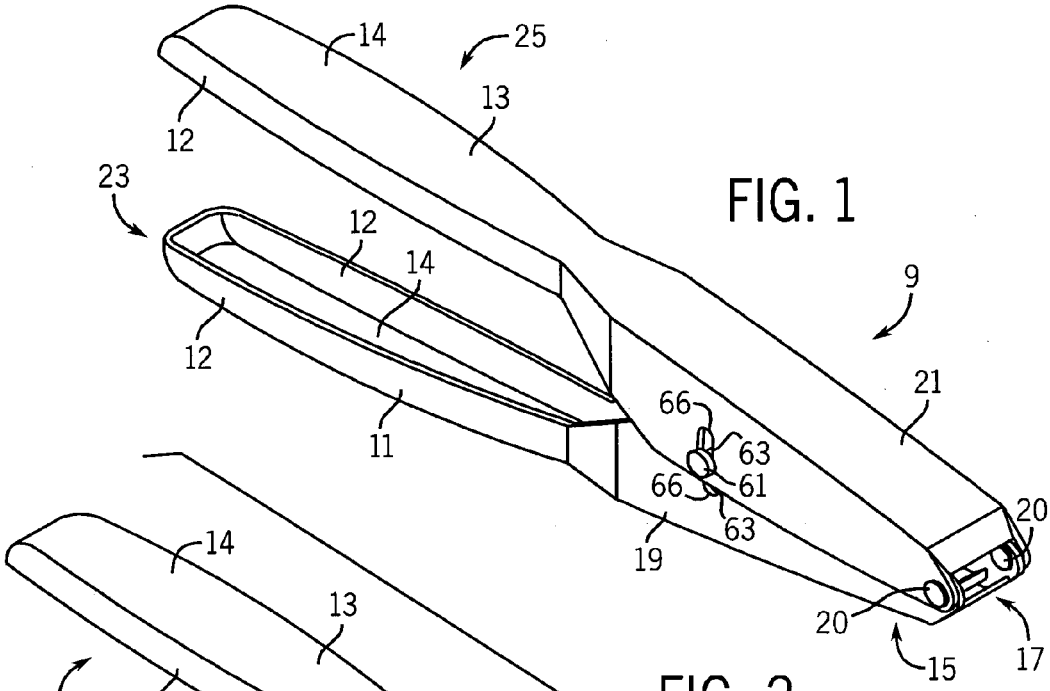
FIG. 1 is a perspective view of the candlewick trimming device.

As shown in FIG. 1, the candlewick trimming device (9) includes first and second elongated gripping arms (11, 13) which are pivotably coupled together at a first end (15). In the preferred embodiment, the first and second gripping arms (11, 13) are pivotably coupled together by rivet connections (20), such that an opening (17) is formed between the first and second gripping arms (11, 13) at the first end (15). However, it will be recognized by those skilled in the art that any suitable means for pivotably connecting the first and second gripping arms (11, 13) will suffice, such as bolt connections, pin connections, or the like. The candlewick trimming device (9) is preferably made of stainless steel, however any comparable structural material may be used, for example, plastic, aluminum or the like.

As shown in FIG. 1, the first and second gripping arms (11, 13) have a generally U-shaped cross section and are arranged to face each other. More specifically, each of the gripping arms has a pair of U-arms (12) and a base (14). The first and second gripping arms (11, 13) are sized and shaped such that a first end portion (19) of the first gripping arm (11) is narrower than the first end portion (21) of the second gripping arm (13). As such, when pivotably coupled together, the U-arms (12) of the first end portion (19) of the first gripping arm (11) fit within the U-arms (12) of the first end portion (21) of the second gripping arm (13).

To facilitate manual operation of the device (9), the second end portions (23, 25) of the first and second gripping arms (11, 13) are ergonomically shaped. More specifically, the first and second gripping arms (11, 13) gradually narrow and then widen along their longitudinal length from their respective first end portions (19, 21) to their second end portions (23, 25). It will be recognized by those skilled in the art that alternate embodiments of the first and second gripping arms (11, 13) may be shaped differently and, for example, include ridges and/or curvatures to better suit the size and shape of the hand of the particular individual utilizing the device (9). However, a general object of the first and second gripping arms (11, 13) is that they are shaped and sized such that they are comfortable to manually grasp and use to trim a candlewick.

Figure 2:
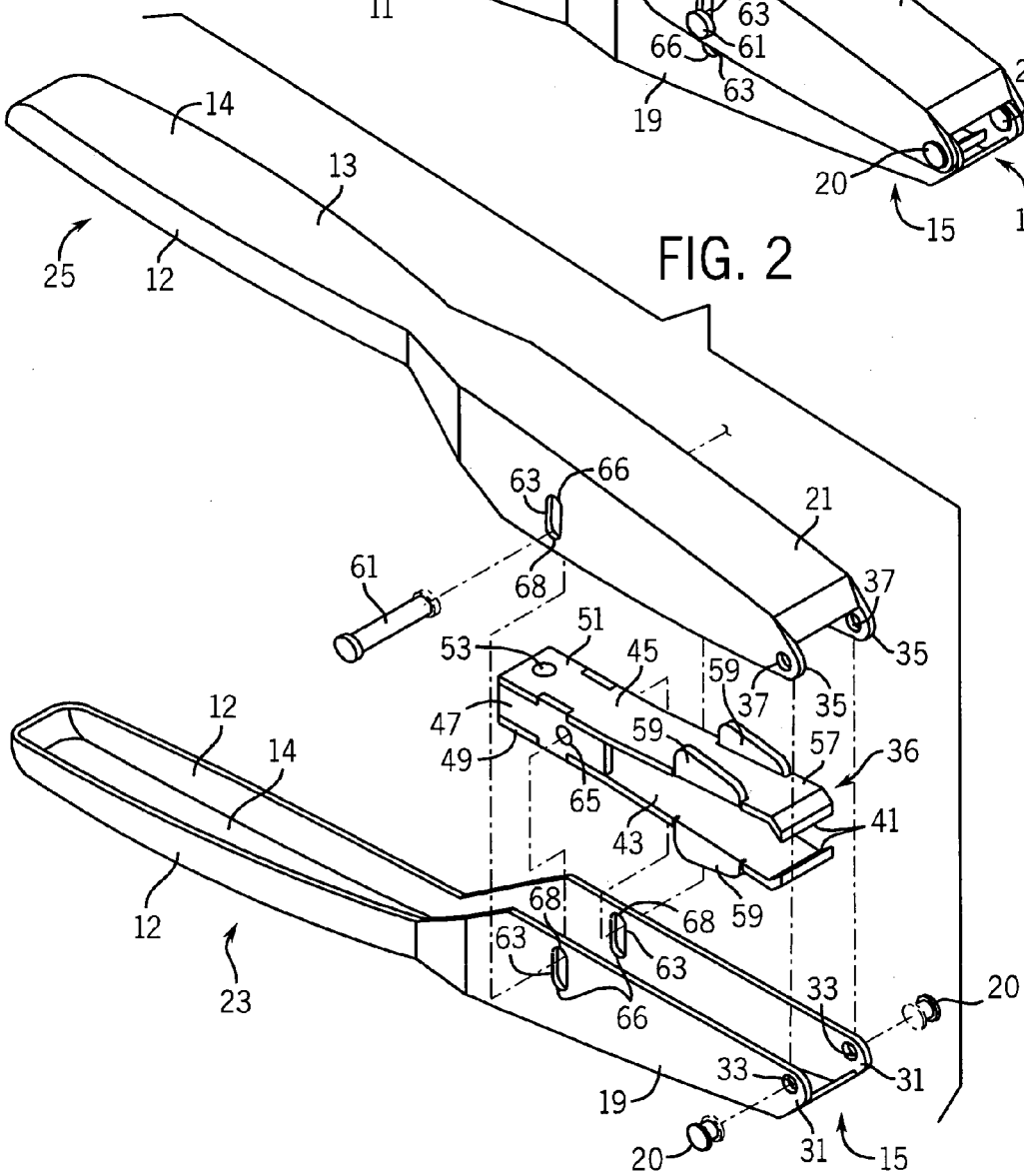
FIG. 2 is an exploded perspective view of a first embodiment of candlewick trimming device.

Referring to FIG. 2, the first end (15) of the first gripping arm (11) has a pair of flanges (31), each having a hole (33) formed therethrough. Because, as stated above, the first end portion (19) of the first gripping arm (11) is narrower than the first end portion (21) of the second gripping arm (13), flanges (31) of the first gripping arm (11) fit within the U-arms (12) of the first end portion (21) of the second gripping arm (13). The first end (15) of the second gripping arm (13) also has a pair of flanges (35), each having a hole (37) formed therethrough. To assemble the device, the first end portion (19) of the first gripping arm (11) is fit within the first end portion (21) of the second gripping arm (13) such that holes (33) and holes (37) are aligned. The first and second gripping arms (11, 13) are thereafter pivotably mounted to each other by rivets (20) such that a pivotable connection results between the first and second gripping arms (11, 13). As stated above, it is not crucial that the first and second gripping arms (11, 13) are connected by rivets (20), however it is important that the arms (11, 13) are pivotable and that the opening (17) is formed at the first end (15) of the device (9).

Referring to FIG. 2, the candlewick trimming device (9) further includes a cutting unit (36) which, in the embodiment shown, includes a pair of cutting blades (41) disposed between and oriented transverse to the elongated first and second gripping arms (11, 13). In the particular embodiment shown, the pair of cutting blades (41) are formed on the respective first end portions (57) of first and second blade arms (43, 45). The first and second blade arms (43, 45) are disposed between the first and second gripping arms (11, 13) when the first and second gripping arms (11, 13) are pivotably connected. In such an orientation, the first and second blade arms (43, 45) are elongated in the same direction as the first and second gripping arms (11, 13).

Referring to FIG. 2, a connection member (47) is sandwiched between the first and second blade arms (43, 45). In the embodiment shown, the connection member (47) is U-shaped and fixably interconnects the second end portions (49, 51) of the first and second blade arms (43, 45). To further the connection, a vertical pin (53) (more clearly shown on FIGS. 3 and 4) extends through the first blade arm (43), connection member (47), and second blade arm (45). Because the connection member (47) is U-shaped, the vertical pin (53) does not directly engage the connection member (47). However, it will also be recognized by those skilled in the art that the connection member (47) does not have to be U-shaped. The connection member (47) may be formed in any one of a variety of shapes that sufficiently connect the first and second blade arms (43, 45). For example the connection member (47) may comprise a solid block or may be square-shaped and have an open center.

Also, although the cutting unit (36) in the particular embodiment shown in FIG. 2 includes separate first and second blade arms (43, 45) and the connection member (47) joined together, it will be recognized by those skilled in the art that the cutting unit (36) may be formed from a single piece of material, or alternatively may be formed of first and second cutting blades shaped and joined together such that they are capable of performing a cutting action.

Figure 3:
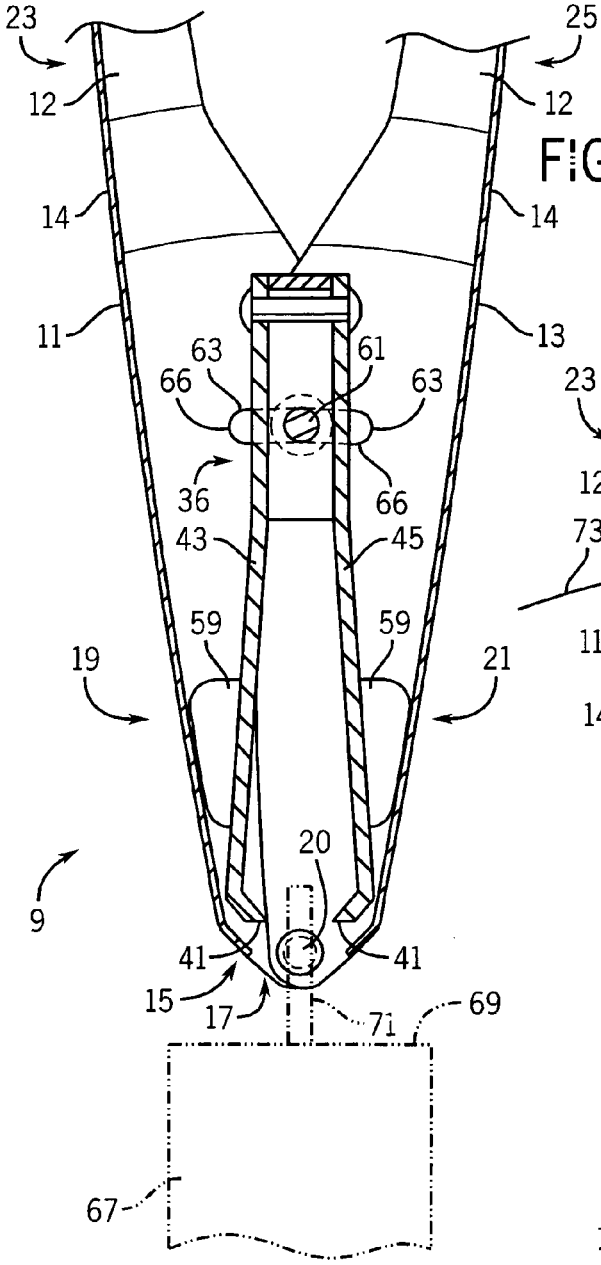
FIG. 3 is a sectional side view of the candlewick trimming device as it is placed on the fuel portion of a candle.

As shown in FIGS. 2 and 3, the first end portions (57) of the blade arms (43, 45) are slightly bowed outwardly away from each other in a resting condition. As will be described further below, after the first and second blade arms (43, 45) are forced into a trimming action by the first and second gripping arms (11, 13), the resiliency of the bowed blade arms (43, 45) forces the gripping arms back out into an extended position, as shown in FIG. 1.

As shown in FIG. 2, the first end portions (57) of the first and second blade arms (43, 45) each include a pair of vertically extending wing members (59). In a preferred embodiment, the wing members (59) are cut from the same piece of material as the first and second blade arms (43, 45) and thereafter bent into an upwards direction relative to the respective blade arm (43, 45). However, the wing members (59) may be formed from separate pieces of material and connected to the blade arms (43, 45) or the connection member (47) in the vertically extending orientation. In a preferred embodiment, the wing members (59) are smoothly sloped towards the cutting blades (41). As will be described further below, the wing members (59) engage the base (14) of the U-shaped first and second gripping arms (11, 13) when the arms (11, 13) are connected together by the rivets (20) at the first end (15). The wing members (59) transfer the pivoting movement from the first and second gripping arms (11, 13) onto the first and second blade arms (43, 45). The smooth slope of the wing members (59) allows the members to be in continuous contact with the base (14) of the respective first and second gripping arms (11, 13) during pivoting action.

Referring to FIG. 2, the first and second gripping arms (11, 13) and the connection member (47) are interconnected by pin (61). More specifically, pin (61) is fitted through a pair of elongated slots (63) formed on each leg of the U-shaped first and second gripping arms (11, 13). The pin further fits through a hole (65) in the connection member to interconnect the connection member (47) and the first and second gripping arms (11, 13). As described below, the combined length of the slots (63) determines the range of pivoting motion of the first and second gripping members (11, 13) during trimming.

Figure 4:
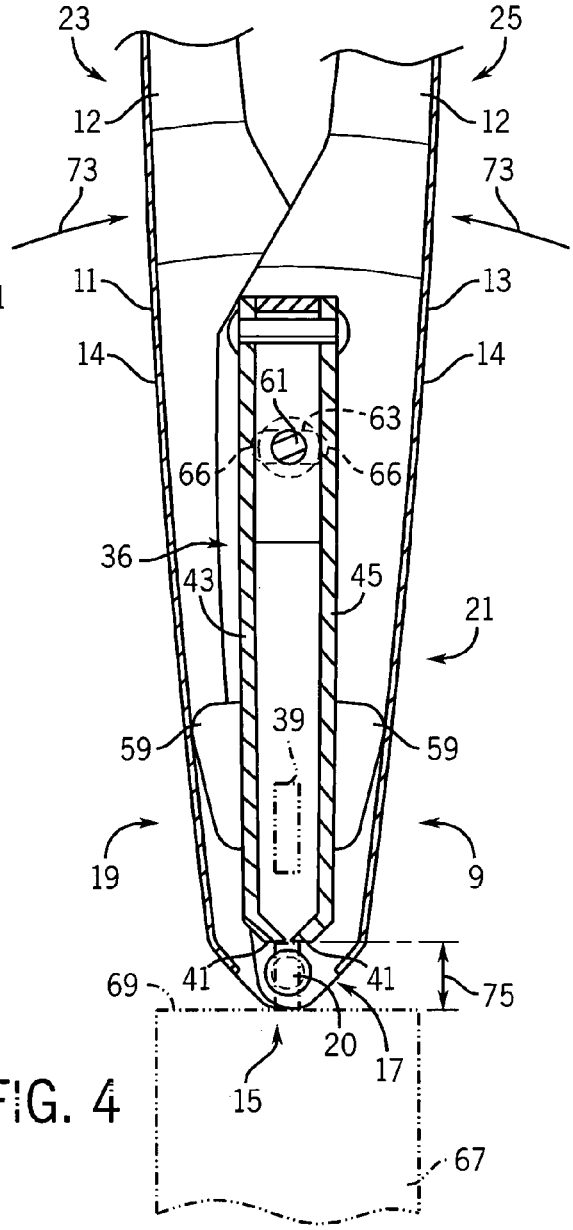
FIG. 4 is a sectional side view of the candlewick trimming device as it is trimming a candlewick at a predetermined height above a candle.

Referring to FIGS. 3 and 4, operation of the present embodiment of the candlewick trimming device (9) will be described. As shown in phantom, a candle (67) has a top portion or "fuel portion" (69) from which a candlewick (71) extends. To trim the candlewick (71) at a predetermined height, the first end (15) of the candlewick trimming device (9) is lowered onto the fuel portion (69) of the candle (67) such that the candlewick (71) extends through the opening (17) formed between the first and second gripping arms (11, 13). Referring to FIG. 4, once the first end (15) of the candlewick trimming device (9) is disposed onto the fuel portion (69) of the candle (67), a user manually grips the first and second gripping arms (11, 13) to pivot the first and second gripping arms (11, 13) towards each other about the rivets (20), as shown by arrows (73). The pivoting movement of the first and second gripping arms (11, 13) is dictated by the length of the slots (63) on the first and second gripping arms (11, 13). In other words, the first and second gripping arms (11, 13) move relatively towards each other up to the point where pin (61) engages the first ends (66) of the slots (63). Simultaneously, the first and second gripping arms (11, 13) push the wing members (59) of the first and second blade arms (43, 45) towards each other to force the culling blades (41) together and trim the candlewick (71). Thus, the amount of pivoting movement of the first and second gripping arms (11, 13) is further dictated by the contact of the cutting blades (41). More specifically, the first and second gripping arms (11, 13) pivot up until the point at which the cutting blades (41) come together and trim the candlewick. The smooth slope of the wing members (59) allows the relative motion between the first and second gripping arms (11, 13) and the wing members (59).

As shown in FIG. 4, the candlewick (71) is trimmed at a predetermined height (75) determined by the distance (75) between the cutting blades (41) and the first end (15) of the first and second gripping arms (11, 13). Accordingly, the candlewick (71) may be consistently trimmed, and re-trimmed at this precise height after or before each use. The trimmed portion (39) of the candlewick (71) is advantageously retained within the trimming device (9) as the device (9) is removed from the fuel portion (69) of the candle (67). As such, the device (9) provides an efficient means for removing the trimmed portion (39) of the candlewick (71).

Once the candlewick (71) is trimmed, the resiliency of the outwardly bowed first and second blade arms (43, 45) forces the first and second gripping arms (11, 13) back out into an open position, as shown in FIG. 1. The first and second gripping arms (11, 13) extend outwardly, away from each other, until the point where the pin (61) meets the second ends (68) of slots (63). As the cutting blades (41) separate, the trimmed portion (39) of the candlewick (71) is free to exit the opening (17) for proper disposal. Thereafter, additional trimming activity may ensue.

Figure 5:
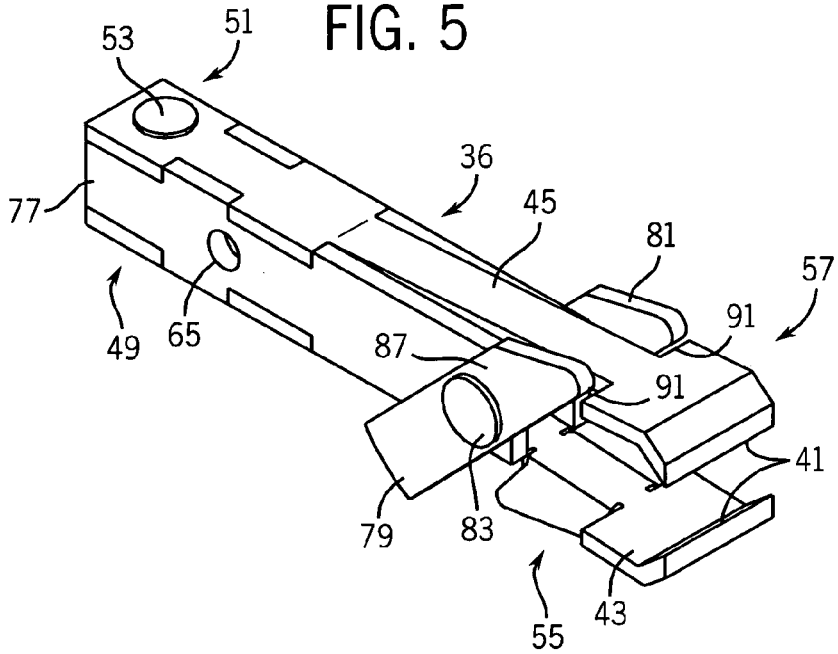
FIG. 5 is a perspective view of a second embodiment of the blade arms.
Figure 6:
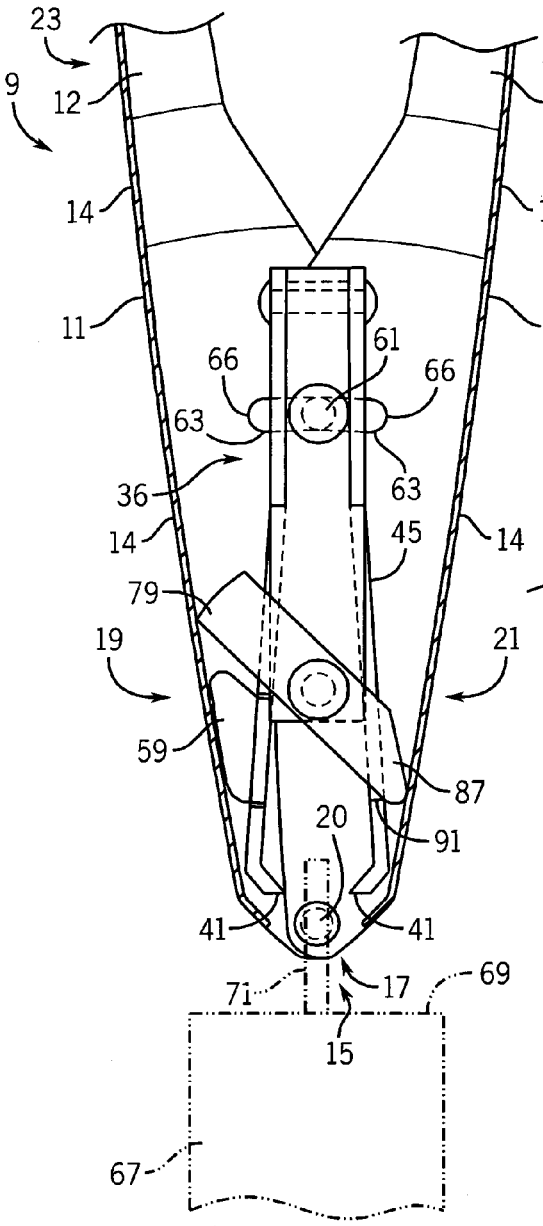
FIG. 6 is a sectional side view of the embodiment of the candlewick trimming device shown in FIG. 5 as it is placed on the fuel portion of a candle.
Figure 7:
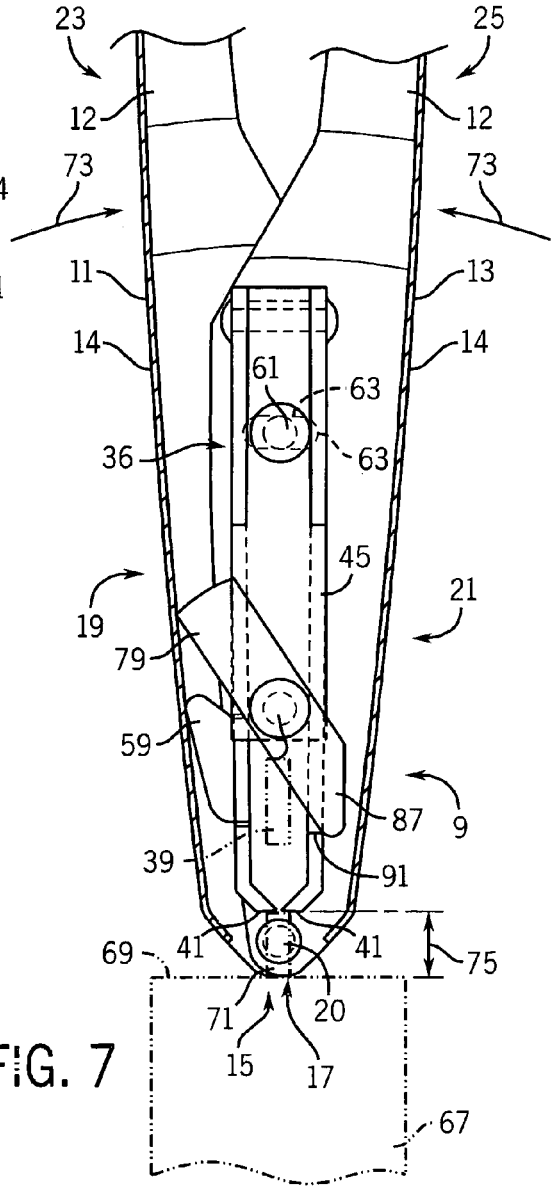
FIG. 7 is a sectional side view of the candlewick trimming device shown in FIG. 6 as it trims a candlewick at a predetermined height above the candle.

Referring now to FIGS. 5–7, an alternate embodiment of the candlewick trimming device is shown. FIG. 5 shows the cutting unit (36) having first and second blade arms (43, 45) that are attached at their respective second end portion (49, 51) by the vertical pin (53). A connection member (77) is sandwiched between the first and second blade arms (43, 45). Similar to the embodiment shown in FIGS. 2–4, the first and second blade arms (43, 45) are bowed outward with respect to each other along the longitudinal length of the first and second blade arms (43, 45) from their respective second end portions (49, 51) towards their first end portion (55, 57). As stated above regarding the embodiment shown in FIG. 2, the cutting unit (36) may instead be formed from a single piece of material, or alternatively from first and second blade arms (43, 45) that are shaped and joined together such that they are capable of performing the cutting action.

First and second lever bars (79, 81) are rotatably attached on opposite sides of the connection member (77). More specifically, the first and second lever bars (79, 81) are rotatably attached to the connection member (77) by an axle (83) which is disposed through the first and second lever bars (79, 81) and the connection member (77). The respective first end portions (87) of the first and second lever bars (79, 81) are sloped away from the cutting blades (41) allow continuous contact with the base (14) of the first gripping arm (11) during pivoting action, as will be described further below. Rotation of the first and second lever bars (79, 81) in the clockwise direction is prevented by flanges (91) formed on either side of the second blade arm (45).

As shown in FIG. 6, similar to the embodiment shown in FIGS. 2–4, the construction shown in FIG. 5 is disposed between the first and second gripping arms (11, 13). As with the embodiment shown in FIGS. 2–4, the first and second blade arms (43, 45) are connected to the first and second gripping arms (11, 13) by means of pin (61) which is disposed through slots (63) on the arms (12) of the first and second gripping arms (11, 13), as well as through hole (65) in connection member (77). When properly positioned between the first and second gripping arms (11, 13), the first and second lever bars (79, 81) abut the base (14) of the first and second gripping arms (11, 13).

Referring to FIG. 6, similar to the embodiment shown in FIGS. 2–4, the first end (15) of the candlewick trimming device (9) is lowered onto the fuel portion (69) of the candle (67) such that the candlewick (71) extends through the opening (17) formed between the first and second gripping arms (11, 13). Referring to FIG. 7, once the first end (15) of the candlewick trimming device (9) is disposed onto the fuel portion (69) of the candle (67), a user manually grips the first and second gripping arms (11, 13) to pivot the first and second gripping arms (11, 13) towards each other, as shown by arrows (73). The pivoting movement of the first and second gripping arms (11, 13) is dictated by the length of the slots (63) on the first and second gripping arms (11, 13). Simultaneously, the first and second gripping arms (11, 13) cause the first and second lever bars (79, 81) to rotate in a clockwise direction. During rotation, the first end portions (87) of the first and second lever bars (79, 81) engage ledges (91) on the second blade arm (45) and translate the pivoting action of the first and second gripping arms (11, 13) onto the second blade arm (45). Simultaneously, the wing members (59) on the second blade arm (45) engage the base (14) of the first gripping arm (11). The combined force of the first and second lever bars (79, 81) on the first blade arm and the base (14) on the wing members (59) cause the first and second blade arms (43, 45) and the cutting blades (41) to come together and trim the candlewick (75).

As shown in FIG. 7, the candlewick (71) is trimmed at a predetermined height (75) determined by the distance (75) between the cutting blades (41) and the first end (15) of the first and second gripping arms (11, 13). Accordingly, the candlewick (71) may be consistently trimmed, and re-trimmed at this precise height after or before each use. The trimmed portion (39) of the candlewick (71) is advantageously retained within the device (9) as the device is removed from the fuel portion (69) of the candle (67).

As with the embodiment shown in FIGS. 2–4, once the candlewick (71) is trimmed, the resiliency of the outwardly bowed first and second blade arms (43, 45) forces the first and second gripping arms (11, 13) back into an open position, as shown in FIG. 1. The first and second gripping arms (11, 13) extend outwardly, away from each other, until the point where the pin (61) meets the second ends (68) of slots (63). As the cutting blades (41) separate, the trimmed portion (39) of the candlewick (71) may be properly discarded. Thereafter, additional trimming activity may ensue.

It will thus be recognized by those skilled in the art that the present invention provides a significantly improved device that trims a candlewick at a predetermined height and that is easy to use and eliminates the many drawbacks of the prior art. The present invention accurately cuts the candlewick at the predetermined height. The device is easy to construct and includes a minimal number of parts, thus minimizing the chance for mechanical breakdown. The device may be accurately used to trim candlewicks on candles that reside within housings, hurricanes, candle jars, or the like.

While this invention is susceptible to embodiments in many different forms, the drawings and specification describe in detail preferred embodiments of the invention. They are not intended to limit the broad aspects of the invention to the embodiments illustrated.

What is claimed is:

1. A device for trimming a candlewick at a predetermined height above a fuel portion of a candle, the device comprising:

first and second elongated gripping arms pivotably coupled to each other at a first end, wherein an opening is formed at the first end between the first and second gripping arms; and a pair of cutting blades arranged between and transverse to the elongated gripping arms, the cutting blades spaced a distance away from the first end of the first and second gripping arms, the distance being equal to the predetermined height;

wherein when the first end of the first and second gripping arms is set on the fuel portion of the candle such that the candlewick extends through the opening, pivoting the first and second gripping arms causes the cutting blades to trim the candlewick at the predetermined height, and further wherein the first and second gripping arms have a U-shaped cross section and face each other, and at least a first end portion of the first gripping arm is narrower than a first end portion of the second gripping arm such that the first portion of the first gripping arm fits within the first portion of the second gripping arm.

2. The device for trimming a candlewick of claim 1, wherein the pair of cutting blades are formed on a pair of blade arms that are elongated along the length of the first and second gripping arms.

3. The device for trimming a candlewick of claim 2, wherein the pair of blade arms have second ends that are rigidly attached to each other.

4. The device for trimming a candlewick of claim 3, further comprising a connection member sandwiched between the pair of blade arms.

5. The device for trimming a candlewick of claim 4, where the connection member is U-shaped and elongated along the length of the first and second blade arms.

6. The device for trimming a candlewick of claim 4, further comprising at least one pin extending vertically through and interconnecting the connection member and the first and second blade arms.

7. The device for trimming a candlewick of claim 4, further comprising a pin extending laterally through and interconnecting the U-shaped first and second gripping arms, the connection member, and the pair of blade arms.

8. The device for trimming a candlewick of claim 7, wherein the pin resides in vertical slots formed in each of the first and second gripping arms and in a hole formed laterally through the connection member.

9. The device for trimming a candlewick of claim 4, further comprising first and second lever bars rotatably attached on opposite sides of the connection member for translating pivoting action from the first and second gripping arms to the pair of cutting blades.

10. The device for trimming a candlewick of claim 9 wherein the lever bars are rotatably attached to the connection member by an axle.

11. The device for trimming a candlewick of claim 1, wherein the first and second gripping arms are connected at the first end by at least one rivet.

12. The device for trimming a candlewick of claim 1, wherein the first and second gripping arms are connected at the first end by at least one pin.

13. The device for trimming a candlewick of claim 1, wherein the first and second gripping arms are connected at the first end by at least one bolt.

14. The device for trimming a candlewick of claim 2, further comprising a pair of wings extending vertically from a first end portion of the blade arms for translating pivoting action from the first and second gripping arms to the pair of cutting blades.

15. A device for trimming a candlewick at a predetermined height above a fuel portion of a candle, the device comprising:

first and second elongated gripping arms pivotably coupled to each other at a first end, wherein an opening is formed at the first end between the first and second gripping arms;

a pair of cutting blades arranged between and transverse to the elongated gripping arms, the cutting blades spaced a distance away from the first end of the first and second gripping arms, the distance being equal to the predetermined height;

wherein the pair of cutting blades are formed on a pair of blade arms that are elongated along the length of the first and second gripping arms; and a pair of wings extending vertically from a first end portion of the blade arms for translating pivoting action from the first and second gripping arms to the pair of cutting blades;

wherein when the first end of the first and second gripping arms is set on the fuel portion of the candle such that the candlewick extends through the opening, pivoting the first and second gripping arms causes the cutting blades to trim the candlewick at the predetermined height.

16. A device for trimming a candlewick at a predetermined height above a fuel portion of a candle, the device comprising:

first and second elongated gripping arms pivotably coupled to each other at a first end, wherein an opening is formed at the first end between the first and second gripping arms;

a pair of cutting blades arranged between and transverse to the elongated gripping arms, the cutting blades spaced a distance away from the first end of the first and second gripping arms, the distance being equal to the predetermined height;

wherein the pair of cutting blades are formed on a pair of blade arms that are elongated along the length of the first and second gripping arms;

a connection member sandwiched between the pair of blade arms; and first and second lever bars rotatably attached on opposite sides of the connection member for translating pivoting action from the first and second gripping arms to the pair of cutting blades;

wherein when the first end of the first and second gripping arms is set on the fuel portion of the candle such that the candlewick extends through the opening, pivoting the first and second gripping arms causes the cutting blades to trim the candlewick at the predetermined height.

* * * * *